US011419377B2

(12) United States Patent
Krueger et al.

(10) Patent No.: US 11,419,377 B2
(45) Date of Patent: Aug. 23, 2022

(54) INFLATABLE HEADGEAR COMPRISING A WIND INSTRUMENT

(71) Applicants: Leif Christian Krueger, Laboe (DE); Malte Timm, Hamburg (DE)

(72) Inventors: Leif Christian Krueger, Laboe (DE); Malte Timm, Hamburg (DE)

(73) Assignee: Leif Christian Krüger

( * ) Notice: Subject to any disclaimer, the term of this patent is extended or adjusted under 35 U.S.C. 154(b) by 136 days.

(21) Appl. No.: 16/612,435

(22) PCT Filed: May 9, 2018

(86) PCT No.: PCT/EP2018/062087

§ 371 (c)(1),
(2) Date: Nov. 11, 2019

(87) PCT Pub. No.: WO2018/206688

PCT Pub. Date: Nov. 15, 2018

(65) Prior Publication Data

US 2020/0281296 A1 Sep. 10, 2020

(30) Foreign Application Priority Data

May 10, 2017 (EP) ..... 17170442

(51) Int. Cl.

| | |
|---|---|
| ***A42B 1/004*** | (2021.01) |
| ***A42B 1/203*** | (2021.01) |
| ***G10D 7/00*** | (2006.01) |
| ***A63H 37/00*** | (2006.01) |
| *A41D 15/04* | (2006.01) |
| *G10D 9/04* | (2020.01) |

(52) U.S. Cl.

CPC ..... *A42B 1/004* (2013.01); *A42B 1/203* (2013.01); *A63H 37/00* (2013.01); *G10D 7/00* (2013.01); *G10D 9/04* (2013.01)

(58) Field of Classification Search

CPC ..... A41D 15/00; A41D 15/04; A42B 1/00; A42B 1/004; A42B 1/203

USPC ..... 446/26, 27, 199–202, 221; 2/206, 207

See application file for complete search history.

(56) References Cited

U.S. PATENT DOCUMENTS

| | | | | |
|---|---|---|---|---|
| 5,110,316 | A * | 5/1992 | Shaw | G09F 21/02 40/439 |
| 5,903,927 | A | 5/1999 | Wolfe et al. | |
| 5,970,522 | A * | 10/1999 | Apichom | A41G 7/02 2/206 |
| 2013/0340144 | A1 | 12/2013 | Strong | |

FOREIGN PATENT DOCUMENTS

| | | | |
|---|---|---|---|
| DE | 10126642 | A1 | 12/2002 |

OTHER PUBLICATIONS

International Search Report and Written Opinion for International Application PCT/EP2018/062087 Application completed on Jun. 14, 2018.

* cited by examiner

*Primary Examiner* — Kien T Nguyen
(74) *Attorney, Agent, or Firm* — Carlson, Gaskey & Olds, P.C.

(57) ABSTRACT

A headgear includes a head portion at least partly surrounding a head, an inflatable portion having an inflatable volume, a mouthpiece, at least one wind instrument, and an air tube defining a flow connection between the mouthpiece and the inflatable volume. A sound is producible by the at least one wind instrument in answer to air blown into the mouthpiece.

20 Claims, 5 Drawing Sheets

INFLATABLE HEADGEAR COMPRISING A WIND INSTRUMENT

CROSS-REFERENCE TO RELATED APPLICATIONS

This application is the US national phase of PCT/EP2018/062087, filed 9 May 2018.

FIELD

The invention relates to an inflatable sound-generating merchandise article, more particularly, to inflatable fan products and toys.

BACKGROUND

Attending events, in particular sports events, is one of the most favorite leisure time activities since it enables relaxing, being entertained, and cheering with likeminded people for the favorite artist/athlete/team. In general, the attending people often try to attract attention. This is usually done by using/wearing specialized merchandise articles. Also, the attending people commonly try to motivate their artist/athlete/team by creating specific sounds, e.g. by clapping hands, shouting, or whistling. Alternatively, the merchandise articles may incorporate possibilities to generate a sound. Such merchandise articles are typically preferred since they are often configured to provide a greater loudness. Related products are e.g. whistles, horns, party horns, vuvuzelas, etc.

Moreover, sound-generating merchandise articles are also used at other events, namely private parties, e.g. a child's birthday party.

However, sound-generating merchandise articles are often hand-held/supported and/or hand-operated. This means that the user's hands are usually occupied due to the use of the article. Even if the article is not used, the user's hands may be occupied due to holding the article since such an article is typically not worn in a comfortable hand-free manner on the user's body.

DE 198 150 38 A1 discloses a hearing protection device which comprises a head band to enable the device to be worn on the head of the user. In the used position there is an associated cover section to cover over both the ears of the user. An air chamber arrangement is located in the head band extending over both the cover sections. The air chamber arrangement is in fluid connection with at least one air channel used to blow up and inflate the air chamber arrangement. The head band may be designed to be sealed in a ring shape.

SUMMARY

It is an object of the invention to provide a headgear, which can be worn and operated in a comfortable hands-free manner, and which is configured to generate a sound in answer to an airflow provided.

According to an aspect, a headgear is provided, which headgear comprises a head portion at least partly surrounding the head, an inflatable portion having an inflatable volume, a mouthpiece, at least one wind instrument, and an air tube defining a flow connection between the mouthpiece and the inflatable volume. A sound is producible by the at least one wind instrument in answer to air blown into the mouthpiece. The inflatable portion can form a portion of the head portion. Advantageously, the headgear provides the possibility to generate a sound, which headgear can simultaneously be worn in a comfortable manner on the head of a user, and which headgear overcomes the necessity to be hand-operated or hand-held/supported.

According to another aspect, the wind instrument can be in fluid communication with the inflatable portion at an exit opening thereof. This configuration advantageously allows a passage to be defined by the inflatable portion between the mouthpiece and the wind instrument.

According to another aspect, walls defining the inflatable portion and/or the head portion can be flexible. More particularly, the walls defining the inflatable portion and/or the head portion can be made of a sheet-like textile or a sheet-like non-textile. The inflatable portion and/or the head portion advantageously can be made out of a flexible material so as to be configured to comprise a variable volume and furthermore to be formable according to the user's head. For the walls of an inflatable portion and/or a head portion being made out of a sheet-like textile or a sheet-like non-textile, the wall thickness can advantageously be reduced in comparison to non-sheet-like materials.

According to another aspect, the headgear can further comprise at least one flexible shield. The shield can have a flexibility less than that of the walls defining the outer side of the head portion. The flexible shield can be arranged at a forehead area of the head portion. The shield can advantageously provide a comparably greater stiffness to the forehead area of the head portion. Advantageously, the shape of the head portion can partially be influenced and substantially be determined by the shield.

According to another aspect, the inflatable portion can have at least one elongated inflatable protrusion coupled to the head portion. The elongated inflatable protrusion can hang down from the head portion in a non-inflated state and can erect in an inflated state. The shape of the inflatable portion can be influenced by the protrusion which allows the headgear to advantageously exhibit a visual effect by the elongated protrusion given the change between the non-inflated and inflated state.

According to another aspect, the at least one wind instrument can be arranged at a free end of the protrusion. The at least one wind instrument can be in fluid communication with the inflatable volume so that sound can be produced in an at least partly inflated state of the protrusion. In other words, the air which is used to generate the sound via the wind instrument has to traverse the protrusion prior to impinging the wind instrument. This mechanism advantageously ensures that the protrusion is at least partially erected before the air enters the wind instrument and a sound is generated.

According to another aspect, the flow resistance of the wind instrument can be adapted to the flexibility of the wall defining the protrusion so that the protrusion can be inflated before sound is generated by the wind instrument. Preferably, the protrusion can be inflated before air emerges via the wind instrument. In other words, the wind instrument can have the function of a restrictor which is configured to advantageously ensure that the protrusion is fully erected prior to the generation of a sound by the air emerging via the wind instrument. In a non-inflated state, the protrusion may be arranged close to the ears of a user. By the wind instrument featuring a restrictor, it is ensured that the sound is generated only if the wind instrument is at a maximum distance away from the ears of the user, substantially determined by the length of the protrusion.

According to another aspect, the headgear can have, in the inflated state, a crown shape including spikes which are defined by the inflatable protrusions. The protrusion can substantially represent a spike of the crown when it is in the erected state. The at least one wind instrument can be mounted at a free end of the at least one spike. Preferably, wind instruments can be mounted at a free end of each spike. The headgear according to this configuration combines different advantageous aspects, namely a plurality of inflatable protrusions and a shape of particular interest for the market of merchandise articles. The plurality of protrusions advantageously enhances the visual effect of the headgear when being changed between the non-inflated and the inflated state.

According to another aspect, the headgear can further comprise a central chamber which can define a portion of the inflatable volume. The spikes can emanate from the central chamber. The central chamber can advantageously form a circlet of the crown. The central chamber can be a portion of the inflatable portion and/or the head portion. Furthermore, the central chamber can ensure that a plurality of protrusions can be connected to a combined portion of the inflatable volume. In this way, the airflow provided to the protrusions can advantageously be substantially the same for each protrusion.

According to another aspect, the headgear can further comprise a flexible deflecting element. The deflecting element can be provided at the end of the air tube. The deflecting element can be configured to prevent liquid in the air tube from entering the inflatable volume. In particular, the deflecting element may be configured such that especially saliva can be prevented from bypassing the deflecting element. The deflecting element can advantageously prevent saliva or other liquids from entering the inflatable volume where the liquid e.g. potentially could influence the generation of a sound by the wind instrument.

According to another aspect, the air tube and the mouthpiece can be made out of a non-transparent material. A non-transparent material advantageously provides the possibility to prevent that liquids inside the air tube and the mouthpiece are visible from the outside.

According to another aspect, the head portion can further comprise a mount. The mount can be configured for adapting the circumference of the head portion to a head circumference of a user. The mount can be one of a snapback fastener, a hook-and-loop fastener, a mounting strap, and a retaining clip. The headgear including a mount is advantageously adjustable to different head circumferences, which is of particular interest in order to enhance the wear comfort.

The circumference of the head portion of the headgear can advantageously be suitable for head circumferences of equal to or larger than 300 mm and equal to or less than 750 mm.

According to another aspect, the headgear can further comprise a plurality of wind instruments. Sound can be produced simultaneously by the plurality of wind instruments. The plurality of wind instruments advantageously enhances the acoustic effect of the headgear when a sound is produced by the plurality of wind instruments.

According to another aspect, a number of wind instruments can be equal to or greater than seven. The headgear including seven wind instruments advantageously provides the possibility to generate a multifaceted chord since wind instruments with different basic themes may be used.

According to another aspect, the inflatable volume can be between 100 and 3000 milliliters, preferably between 330 and 1200 milliliters. This size of the inflatable volume allows the user to inflate the inflatable volume and generate a sound by the wind instrument not only for a moment, but rather for a time period determined by the user's lung volume. In this way, the generation of the sound can be performed for several seconds.

The wind instrument can be one of a horn, a party horn, a whistle, and a flute.

The protrusion, i.e. the spike, may have a specific length between the central chamber and the free end where the wind instrument is mounted. The length of a protrusion (spike) may advantageously be equal to or greater than 50 mm and equal to or smaller than 700 mm. Further advantageously, the length of a protrusion (spike) may be equal to or greater than 120 mm and equal to or smaller than 250 mm.

According to another aspect, the headgear can have a shape which is substantially determined by the elongated inflatable protrusions coupled to the head portion. In the inflated state, the head gear may have a crown shape or a non-crown shape. For instance, in the inflated state, the head gear may have a crown shape with stars at the ends of the spikes. In the inflated state, the head gear can also have a shape such that the inflatable protrusions have the shape of numbers and/or letters. In the inflated state, the head gear can also have a shape such that the inflatable protrusions have the shape of animals and/or parts of animals such as e.g. horns of a bull.

In general, the number of wind instruments may be equal to or greater than 1 and equal to or smaller than 40, preferably between 3 and 20.

The air tube can advantageously have a length of equal to or more than 100 mm and equal to or less than 1000 mm.

The walls defining the inflatable portion and/or the head portion can be made of a material which prevents saliva to be visible from outside the inflatable portion.

The walls defining the inflatable portion and/or the head portion may be made out of a sheet-like textile, preferably a composite textile. A composite textile is referred to as a multilayered textile comprising layers of substantially different materials. Furthermore, the layers may have different thicknesses, different structures, and may be manufactured in different ways. The individual layers of the composite textile may serve for different functionalities of the composite textile. The composite textile may comprise a highly stretchable insert. The composite textile may provide breathability and complete water resistance against cold, wind, and humidity.

The walls defining the inflatable portion and/or the head portion in particular may be made from R-Tex developed by Reusch, for example. The weight of the composite textile may advantageously be equal to or more than 15 g/m$^2$ and less than 200 g/m$^2$. Further advantageously, the weight of the composite textile may be substantially equal to 42 g/m$^2$.

The walls defining the inflatable portion and/or the head portion may have a printable outer surface. In particular, the outer surfaces of the walls defining the inflatable portion and/or head portion may be configured to be printed with graphical elements, such as logos, characters, emblems, symbols, etc. The outer surfaces of the walls defining the inflatable portion and/or head portion may be configured to be printed with different colors in certain areas.

BRIEF DESCRIPTION OF DRAWINGS

Further aspects and characteristics of the invention will ensue from the following description of preferred embodiments of the invention with reference to the accompanying drawings, wherein.

DETAILED DESCRIPTION OF EMBODIMENTS

Figure 1:
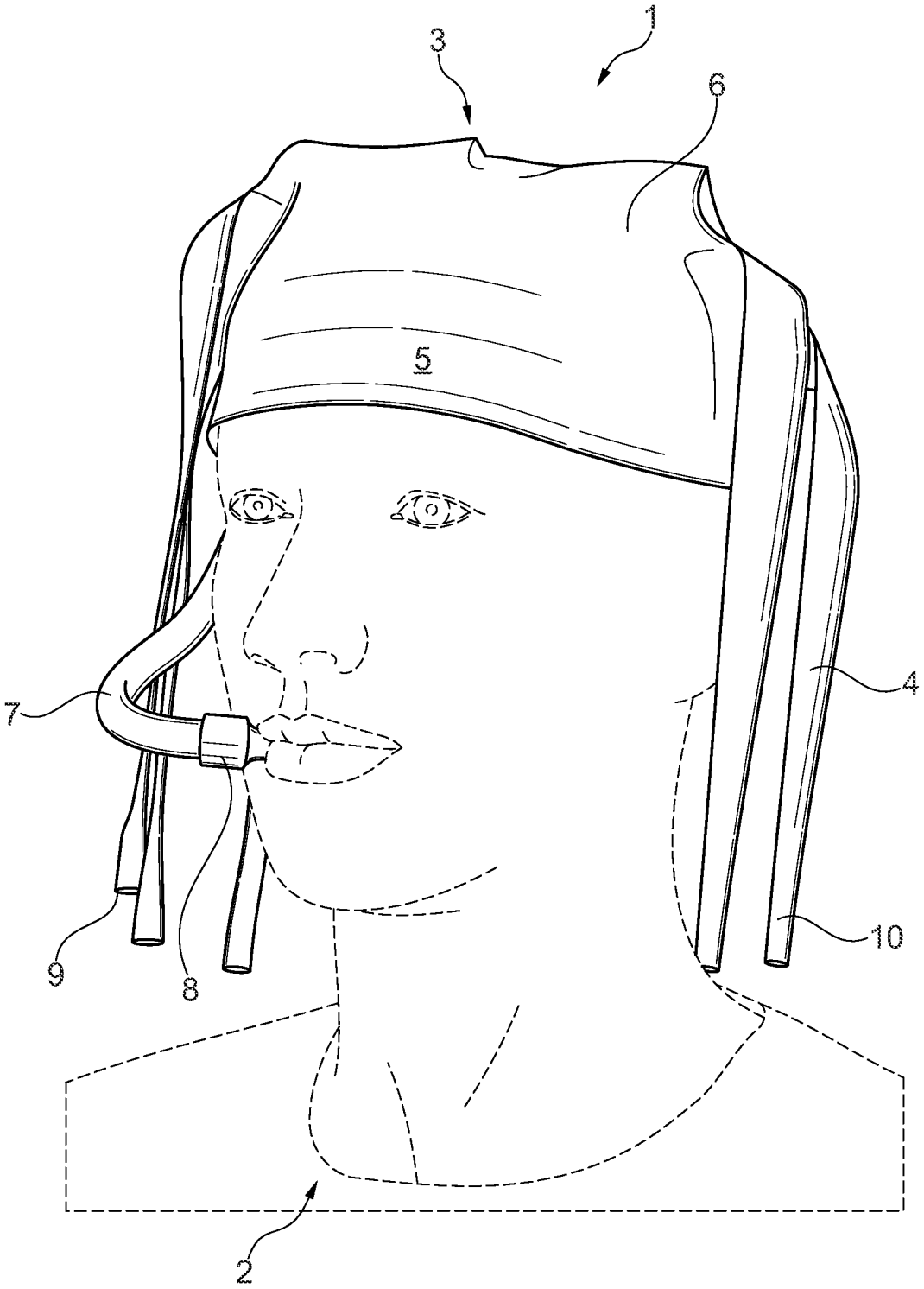
FIG. 1 is a simplified perspective view of the headgear attached to the head of a user.

FIG. 1 is a simplified perspective view of the headgear 1 attached to the head of a user 2. The headgear 1 substantially has the shape of a crown 3 including several protrusions 4. The protrusions 4 substantially reflect the shape of spikes of the crown 3. The portion of the headgear 1 attached to the forehead region of the user 2 substantially reflects the circlet of the crown 3.

The headgear 1 comprises a head portion 5 which is attached to the forehead, to the sides of the head above the ears, and to the back of the head where the head portion comprises a mount. The headgear 1 further comprises an inflatable portion 6. The inflatable portion 6 has an inflatable volume. The head portion 5 is partly given by the inflatable portion 6. The inflatable portion 6 further comprises several protrusions 4, i.e. spikes.

The combined portion of the head portion 5 and the inflatable portion 6 forms a central chamber. The central chamber substantially reflects the circlet of the crown-shaped headgear 1.

The shape of the headgear 1 is substantially rendered possible by the flexibility of the material of the head portion 5 and the inflatable portion 6. The head portion 5 and the inflatable portion 6 are substantially made out of a flexible material. More particularly, head portion 5 and the inflatable portion 6 are substantially made out of a sheet-like composite textile, except specific parts of these portions.

The headgear 1 further comprises an air tube 7, a mouthpiece 8, and wind instruments 9. The air tube 7 provides a flow connection between the mouthpiece 8 and the inflatable volume of the inflatable portion 6.

The material of the walls defining the inflatable portion 6 and/or the head portion 5 of the headgear 1 (except the air tube 7, the mouthpiece 8, and the wind instruments 9) may be a sheet-like textile or a sheet-like non-textile. In particular, the material may be a composite textile, such as R-Tex fabric, for example.

According to this embodiment, the materials of the walls defining the inflatable portion 6 and the head portion 5, the air tube 7, and the mouthpiece 8 are non-transparent materials. This ensures that the interior space of the inflatable portion 6 and the head portion 5, the air tube 7, and the mouthpiece 8 is not visible from the outside. If, for example, saliva enters the interior space of the air tube 7 via the mouthpiece 8, it is not visible from the outside of the air tube 7. However, the materials of the walls defining the inflatable portion 6 and the head portion 5, the air tube 7, and/or the mouthpiece 8 may also be transparent.

The protrusions 4, i.e. the spikes, have a specific length between the central chamber and the free end 10, wherein the free end 10 substantially has the shape of a tapering according to the typical shape of a spike of a crown 3. The length of a protrusion (spike) 4 according to this embodiment is substantially equal to 217 mm.

According to this embodiment, the headgear 1 comprises seven protrusions (spikes) 4. Two of these protrusions (spikes) 4, hang down on the left side of the user's 2 head, two lie loose on the user's 2 head from the forehead towards the back of the head, and three hang down on the right side of the user's 2 head. The headgear 1 is configured such that the middle protrusions (spikes) 4 of the headgear 1 are prevented from hanging down in front of the user's 2 face. This advantageously ensures that the view of the user 2 is not interfered by the headgear 1.

Wind instruments 9 are attached at the free ends 10 of the protrusions (spikes) 4. The wind instruments 9 are in fluid communication with the inflatable portion 6 at an exit opening 12 thereof. The wind instruments 9 may be horns, party horns, whistles, or other instruments configured to create a sound in response to an airflow.

The air tube 7 has a length of approximately 350 mm. The mouthpiece 8 is attached to the first end of the air tube 7. The second end of the air tube 7 is attached to the inflatable portion 6 of the headgear 1. The mouthpiece 8 can easily be taken into the mouth by the user 2.

If the user 2 blows air into the mouthpiece 8, the airflow is applied to the inflatable portion 6 via the air tube 7. In answer to the airflow, the inflatable portion 6 inflates, the protrusions (spikes) 4 erect, and only after the protrusions (spikes) 4 are erected, a sound is generated by the wind instruments 9. This feature is substantially ensured by positioning the wind instruments at the free ends 10 of the protrusions (spikes) 4 and by a predetermined flow resistance of the wind instruments 9. The flow resistance of the wind instruments 9 is adapted to the flexibility of the outer walls defining the protrusion (spike) 4 such that an erection of the protrusion (spike) 4 is a prerequisite for a generation of a sound of the wind instrument 9 of the protrusion (spike) 4.

Figure 2:
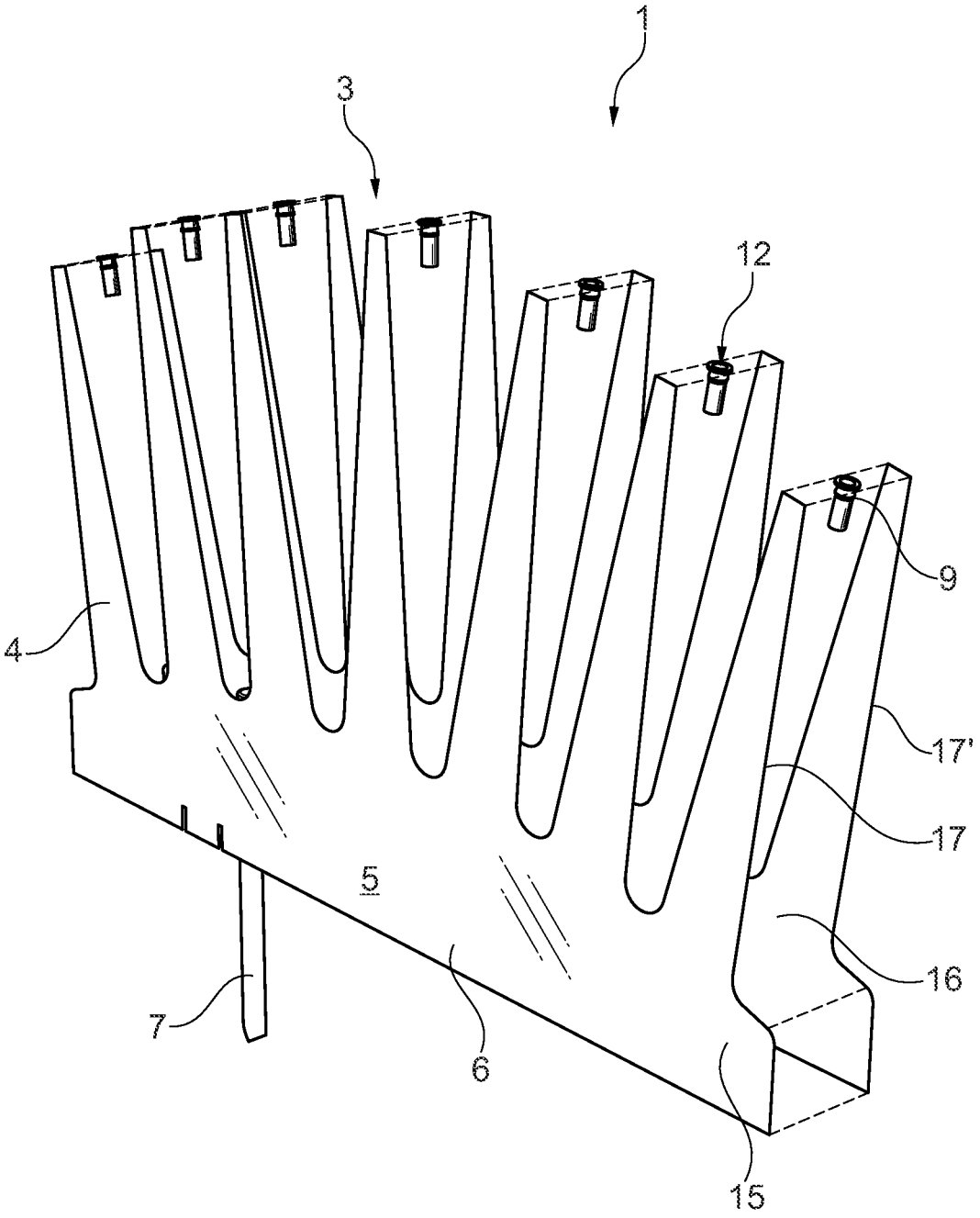
FIG. 2 is a simplified perspective exploded view of the headgear.

FIG. 2 is a simplified perspective exploded view of the headgear 1 with erected protrusions (spikes) 4. There is a first layer 15 and a second layer 16 of the head portion 5 and the inflatable portion 6 which are separated by a distance according to the exploded view. This embodiment shows seven protrusions (spikes) 4 and seven wind instruments 9 positioned at the free ends 10 of the protrusions (spikes) 4 accordingly.

The inflatable portion 6 of the headgear 1 (except the air tube 7, the mouthpiece 8, and the wind instruments 9) is determined by the two layers 15, 16 of a sheet-like material. These are cut according to the shape of the headgear 1 and connected to each other at their outer perimeters 17, 17', whereas the connection is skipped for specific sections of the outer perimeters 17, 17' so as to provide possibilities for attaching the air tube 7 and the wind instruments 9. The technique used for connecting both layers 15, 16 may be any appropriate technique, such as stitching, fusing, bonding, pressing, etc. The sheet-like material may also comprise only a single layer, whereas the single layer may be mirror symmetric.

Figure 3:
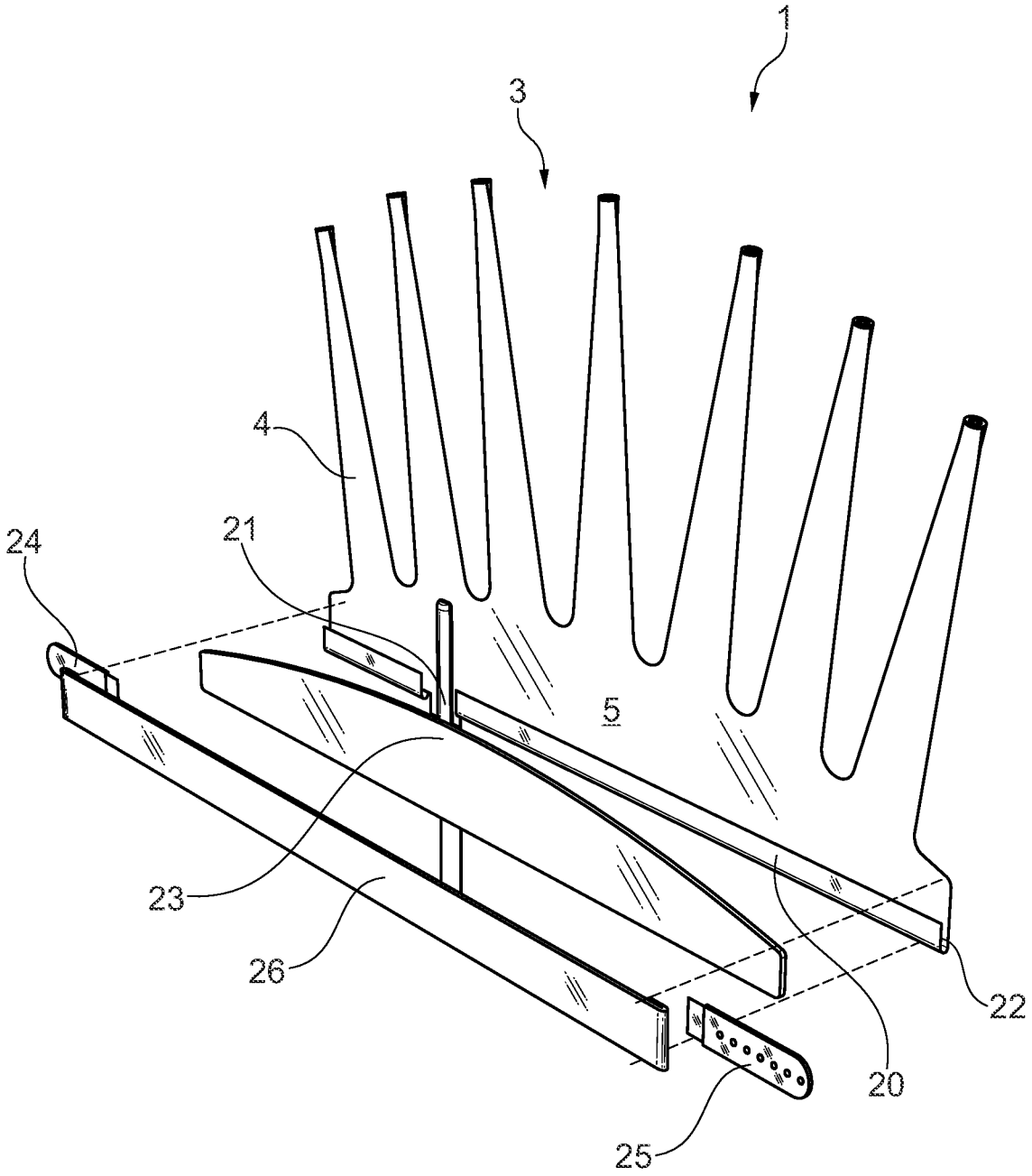
FIG. 3 is a simplified perspective exploded view of the headgear from the back side.

FIG. 3 is a simplified perspective exploded view of the headgear 1 from the back side. A bottom portion 20 of the sheet-like material can be seen which is turned around except for the section 21 where the air tube 7 is attached. In this way, the bottom portion 20 creates a partial slit 22. The head portion 5 further comprises a flexible shield 23, a mount 24, 25, and a headband 26.

In the depicted embodiment, the mount 24, 25 is a two-piece snapback device 24, 25.

The flexible shield 23 is made of felt material. The shape of the flexible shield 23 substantially reflects the lower portion of the crown 3, i.e. the circlet of the crown 3.

The two-piece snapback device 24, 25 is configured to provide a possibility to attach the headgear 1 to a user's 2 head.

The headband 26 is configured to absorb the user's 2 perspiration. The headband 26 advantageously has an appropriate absorptive capacity in order to absorb the user's 2 perspiration. In the present embodiment, the headband is made of cotton. The headband can also be made of a synthetic fiber.

Figure 4:
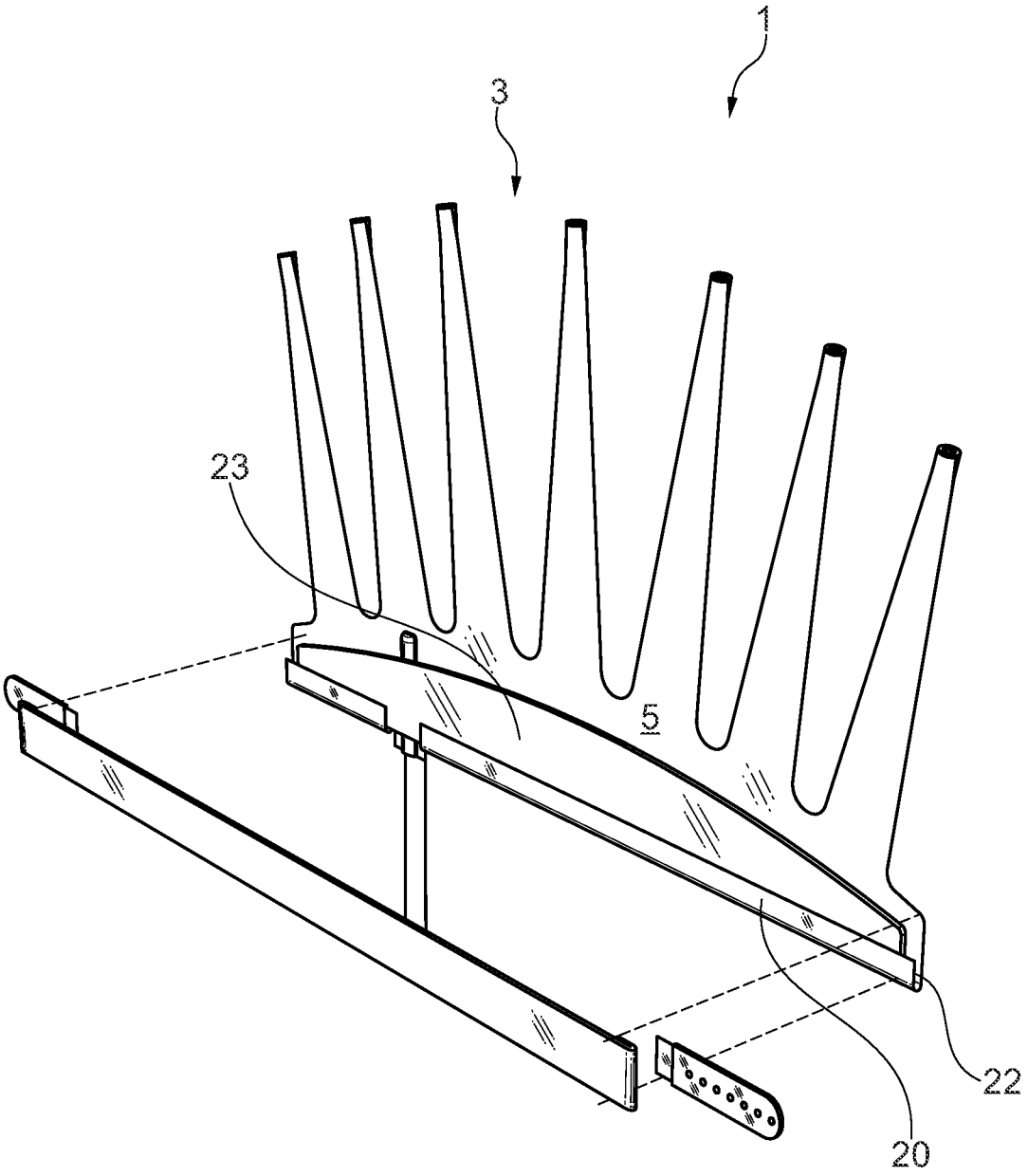
FIG. 4 is another simplified perspective exploded view of the headgear from the back side.

FIG. 4 is another simplified perspective exploded view of the headgear 1 from the back side. The flexible shield 23 is inserted into the partial slit 22 which is generated by turning around the bottom portion 20 of the sheet-like material. The flexible shield 23 stabilizes especially the lower portion of the sheet-like material, i.e. the circlet of the crown 3. The flexible shield has a smaller flexibility than the walls defining the outer side of the head portion 5. The shield is configured to force a desired shape of the adjacent portion of the inflatable portion 6, if the inflatable portion 6 is non-inflated. In other words, the flexible shield 23 is configured such that the middle protrusions (spikes) 4 of the crown 3 do not hang down in front of the face of the user 2, but instead fall down towards the back of the head if no airflow is provided to the inflatable portion 6.

Figure 5:
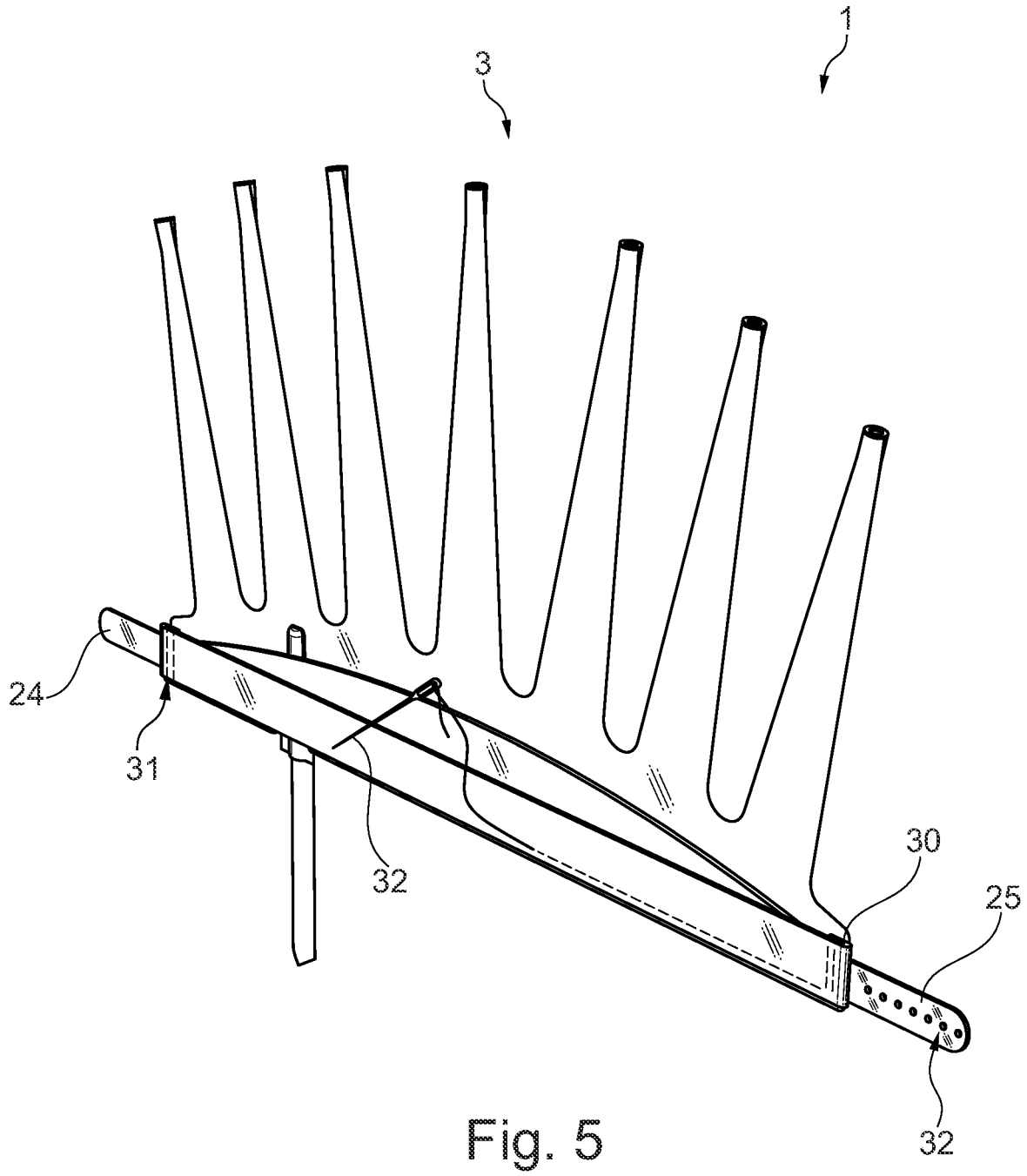
FIG. 5 is a simplified perspective view of the headgear from the back side.

FIG. 5 is a simplified perspective view of the headgear 1 from the back side. The two-piece snapback device is attached to the side end portions of the sheet-like material. The headband 26 is attached to the lower portion of the sheet-like material.

The headband 26 has a substantially rectangular shape, whereas the side ends are turned around to provide a two layer headband 30 in these regions, which provides increased material thickness in these regions. The sheet-like material, the shield 23, the two-piece snapback device 24, 25, and the headband 26 are mounted to each other by stitching 32. Alternatively, a different appropriate technique such as fusing may be used. At the side ends, a twin seam 31 is applied in order to improve the stability of the connection at these portions since these connections have to withstand a tensile force transferred from the mount, i.e. the snapback device 24, 25, if the headgear 1 is attached to a user's 2 head.

Furthermore, the snapback device 24, 25 provides adjustability of the headgear 1 with respect to the head circumference of a user 2. A pin of the first part 24 of the snapback device 24, 25 can be applied to different recesses 32 of the second part 25 of the snapback device 24, 25 which results in different effective circumferences of the head portion 5 of the headgear 1. The effective circumference of the headgear 1 can be suitable for a head circumference of equal to or larger than 520 mm and equal to or less than 630 mm.

Although the invention has been described hereinabove with reference to specific embodiments, it is not limited to these embodiments, and further alternatives will occur to the skilled person that lie within the scope of the invention as claimed.

The invention claimed is:

1. A headgear comprising:

a head portion configured to at least partly surround a head;

an inflatable portion having an inflatable volume;

a mouthpiece;

at least one wind instrument; and an air tube defining a flow connection between the mouthpiece and the inflatable volume, and wherein a sound is producible by the at least one wind instrument in answer to air blown into the mouthpiece, and wherein the at least one wind instrument is in fluid communication with the inflatable portion at an exit opening thereof.

2. The headgear according to claim 1, wherein walls defining the inflatable portion and/or the head portion are flexible, more particular wherein the walls defining the inflatable portion and/or the head portion are made of a sheet-like textile and/or a sheet-like non-textile.

3. The headgear according to claim 2, including at least one flexible shield having a flexibility less than that of the walls defining an outer side of the head portion, wherein the at least one flexible shield is arranged at a forehead area of the head portion.

4. The headgear according to claim 3, wherein the inflatable portion has plurality of elongated inflatable protrusions, and wherein the headgear, in an inflated state thereof, has a crown shape including a plurality of spikes which are defined by the plurality of elongated inflatable protrusions, and wherein the at least one wind instrument is mounted at a free end of at least one spike of the plurality of spikes, preferably at each spike.

5. The headgear according to claim 4, wherein a central chamber defining a portion of the inflatable volume is provided, the plurality of spikes emanating from the central chamber.

6. The headgear according to claim 2, wherein the inflatable portion has at least one elongated inflatable protrusion coupled to the head portion, and wherein the at least one elongated inflatable protrusion, in a non-inflated state, hangs down from the head portion and, in an inflated state, erects.

7. The headgear according to claim 1, wherein the air tube and the mouthpiece are made out of a non-transparent material.

8. The headgear according to claim 1, wherein the head portion further comprises a mount to adapt a circumference of the head portion to a head circumference of a user, and wherein the mount is one of a snapback fastener, a hook-and-loop fastener, a mounting strap, and a retaining clip.

9. The headgear according to claim 1, wherein the at least one wind instrument comprises a plurality of wind instruments, and wherein sound is producible simultaneously by the plurality of wind instruments.

10. The headgear according to claim 9, wherein a number of the plurality of wind instruments is within a range of 1 to 10.

11. The headgear according to claim 1, wherein the inflatable volume is between 100 and 3000 milliliter.

12. A headgear comprising:

a head portion configured to at least partly surround a head;

an inflatable portion having an inflatable volume, and wherein the inflatable portion has at least one elongated inflatable protrusion coupled to the head portion, and wherein the at least one elongated inflatable protrusion, in a non-inflated state, hangs down from the head portion and, in an inflated state, erects;

a mouthpiece;

at least one wind instrument;

an air tube defining a flow connection between the mouthpiece and the inflatable volume, and wherein a sound is producible by the at least one wind instrument in answer to air blown into the mouthpiece, and wherein walls defining the inflatable portion and/or the head portion are flexible, more particular wherein the walls defining the inflatable portion and/or the head portion are made of a sheet-like textile and/or a sheet-like non-textile; and wherein the at least one wind instrument is arranged at a free end of the at least one elongated inflatable protrusion and is in fluid communication with the inflatable volume so that sound is produced in an at least partly inflated state of the at least one elongated inflatable protrusion.

13. The headgear according to claim 12, wherein flow resistance of the at least one wind instrument is adapted to the flexibility of the wall defining the at least one elongated inflatable protrusion so that the at least one elongated inflatable protrusion is to be inflated before sound is generated by the at least one wind instrument, preferably before air emerges via the at least one wind instrument.

14. A headgear comprising:

a head portion configured to at least partly surround a head;

an inflatable portion having an inflatable volume;

a mouthpiece;

at least one wind instrument; and an air tube defining a flow connection between the mouthpiece and the inflatable volume, and wherein a sound is producible by the at least one wind instrument in answer to air blown into the mouthpiece, wherein the headgear further comprises a flexible deflecting element, wherein the flexible deflecting element is provided at an end of the air tube and prevents liquid in the air tube from entering the inflatable volume.

15. The headgear according to claim 14, wherein walls defining the inflatable portion and/or the head portion are flexible, more particular wherein the walls defining the inflatable portion and/or the head portion are made of a sheet-like textile and/or a sheet-like non-textile.

16. The headgear according to claim 15, including at least one flexible shield having a flexibility less than that of the walls defining an outer side of the head portion, wherein the at least one flexible shield is arranged at a forehead area of the head portion.

17. The headgear according to claim 15, wherein the inflatable portion has at least one elongated inflatable protrusion coupled to the head portion, and wherein the at least one elongated inflatable protrusion, in a non-inflated state, hangs down from the head portion and, in an inflated state, erects.

18. The headgear according to claim 14, wherein the air tube and the mouthpiece are made out of a non-transparent material.

19. The headgear according to claim 14, wherein the head portion further comprises a mount to adapt a circumference of the head portion to a head circumference of a user, and wherein the mount is one of a snapback fastener, a hook-and-loop fastener, a mounting strap, and a retaining clip.

20. The headgear according to claim 14, wherein the at least one wind instrument comprises a plurality of wind instruments, and wherein sound is producible simultaneously by the plurality of wind instruments.

* * * * *